US005809875A

United States Patent [19]

Tucker

[11] Patent Number: 5,809,875

[45] Date of Patent: Sep. 22, 1998

[54] APPARATUS FOR CRUSHING SCRAP VEHICLE WHEELS

[76] Inventor: Charles Tucker, 8395 Partridge St., Lake, Mich. 48632

[21] Appl. No.: 944,927

[22] Filed: Oct. 6, 1997

[51] Int. Cl.[6] ..... B30B 9/32; B30B 7/04

[52] U.S. Cl. ..... 100/100; 29/403.3; 72/402; 100/23; 100/269.06; 157/1.21

[58] Field of Search ..... 100/91, 100, 232, 100/269.06, 901; 157/1.21; 72/402; 29/403.3

[56] References Cited

U.S. PATENT DOCUMENTS

| | | | |
|---|---|---|---|
| 3,020,831 | 2/1962 | Barnes | 10/232 |
| 3,319,290 | 5/1967 | Clark | 100/232 |
| 4,080,887 | 3/1978 | Larsen | 100/232 |
| 4,083,394 | 4/1978 | Heikkinen et al. | 100/232 |
| 4,387,636 | 6/1983 | Depew et al. | 100/232 |
| 4,804,031 | 2/1989 | Rouse et al. | 157/1.21 |
| 5,495,882 | 3/1996 | Trant | 100/232 |
| 5,573,049 | 11/1996 | Rutter | 100/232 |

*Primary Examiner*—Stephen F. Gerrity
*Attorney, Agent, or Firm*—Reising, Ethington, Learman & McCulloch PLLC

[57] ABSTRACT

Apparatus for crushing scrap vehicle wheels includes a frame constructed from three radially disposed rectangular tube beams each mounting a hydraulic cylinder and crushing head which converge and operate radially to deform a scrap wheel supported at the center of the frame in order to separate the steel rim of the wheel from the surrounding tire casing. Each crushing head is supported against upward deflection by an interlocking slide connection including a slide carriage fixed to each head and slideable along the beam and stationary hold down brackets mounted on the opposite side of each beam and vertically adjustable for controlling the hold down pressure exerted on the carriages.

14 Claims, 5 Drawing Sheets

APPARATUS FOR CRUSHING SCRAP VEHICLE WHEELS

This invention relates generally to apparatus for crushing scrap vehicle wheels and more particularly to such apparatus having multiple radially inwardly directed crushing heads and the means of supporting the crushing heads under load.

BACKGROUND OF THE INVENTION

Apparatus for crushing scrap wheels having multiple radially inwardly directed crushing heads are known to the art and disclosed, for example, in U.S. Pat. No. 4,080,887 to Larsen. The frame of Larsen is constructed of three intersecting T-beams The crushing heads are tied to the top plates of the T-beams by interlocking slide plates. The slide plates wrap beneath the top plates of each beam and serve to support the heads against upward deflection when under load. Side forces applied to the crushing heads when under load are transmitted to the narrow side edges of the top plate of each T-beam by the interlocking slide plates. Over time, such side loading has a tendency to erode the top plates of the beams, causing lateral cup-shaped recesses to be worn into the top plate of the beams. Eventually, the fit between the top plate and interlock plates becomes sloppy, no longer providing the needed support to the crushing heads. Since the T-beams constitute the primary frame structure of the apparatus, once they become worn they are not readily replaced.

The present invention overcomes or greatly minimizes the foregoing objections.

SUMMARY OF THE INVENTION

Apparatus for crushing vehicle wheels constructed according to the invention includes a rigid frame having at least three radially disposed beams converging at a central region of the frame each constructed from rectangular metal tubing providing generally horizontal top and bottom walls and generally vertical side walls. A linear actuator is mounted on each beam having an extension arm projecting toward the center of the frame and carrying a crushing head at its free end, with the actuators being operable to displace the crushing heads radially inwardly to impinge upon and radially deform a wheel when supported at the center of the frame and to return the heads radially outwardly to release the crushed wheel and ready the apparatus to crush a subsequently loaded wheel. An adjustable slide connection is provided between the crushing heads and their respective tubular beams. Each connection includes a generally U-shaped elongate carriage having an upper wall overlying the top wall of the associated beam and fixed to the associated crushing head for movement therewith along the beam, and a pair of side walls straddling the side walls of the beams. Each slide carriage is further provided with a pair of flanges that extend laterally outwardly from the side walls of the carriage. Each slide connection further includes stationary carriage guides mounted on each of the tubular beams having hold down flanges that overlie the lateral flanges of the slide carriages to secure the carriages and thus the crushing heads against upward deflection under load, and being adjustable vertically relative to the slide carriages in order to apply more or less hold down pressure on the carriage flanges.

Unlike the T-beams of Larsen, the square tubular beams of the invention provide increased load bearing surface area, particularly with respect to lateral loading as compared to the relatively narrow side faces of the T-beam top plates and are thus less susceptible to wear and cupping as are the T-beams. According to a preferred embodiment, the carriages carry replaceable wear plates that slide in contact with the tubular beams. When worn, they are easily replaced and preserve the integrity of the tubular beams.

Another advantage that the hold down system of the invention provides is that it is able to compensate for wear between the sliding and stationary components. The stationary carriage guides are adjustable vertically on the beams to compensate for wear between the confronting flanges of the carriages and their guides. The adjustment of the hold down system also allows more or less hold down pressure to be applied to the slide carriages. In this way, the resistance to movement of the individual actuators can be adjusted for equalizing their actuation, eliminating the need for a separate hydraulic equalizer unit as called for by Larsen.

THE DRAWINGS

A presently preferred embodiment of the invention is disclosed in the following description and in the accompanying drawings, wherein:

FIG. 6 is a schematic view of the hydraulic circuit for operating the cylinders; and.

DETAILED DESCRIPTION

Figure 1:
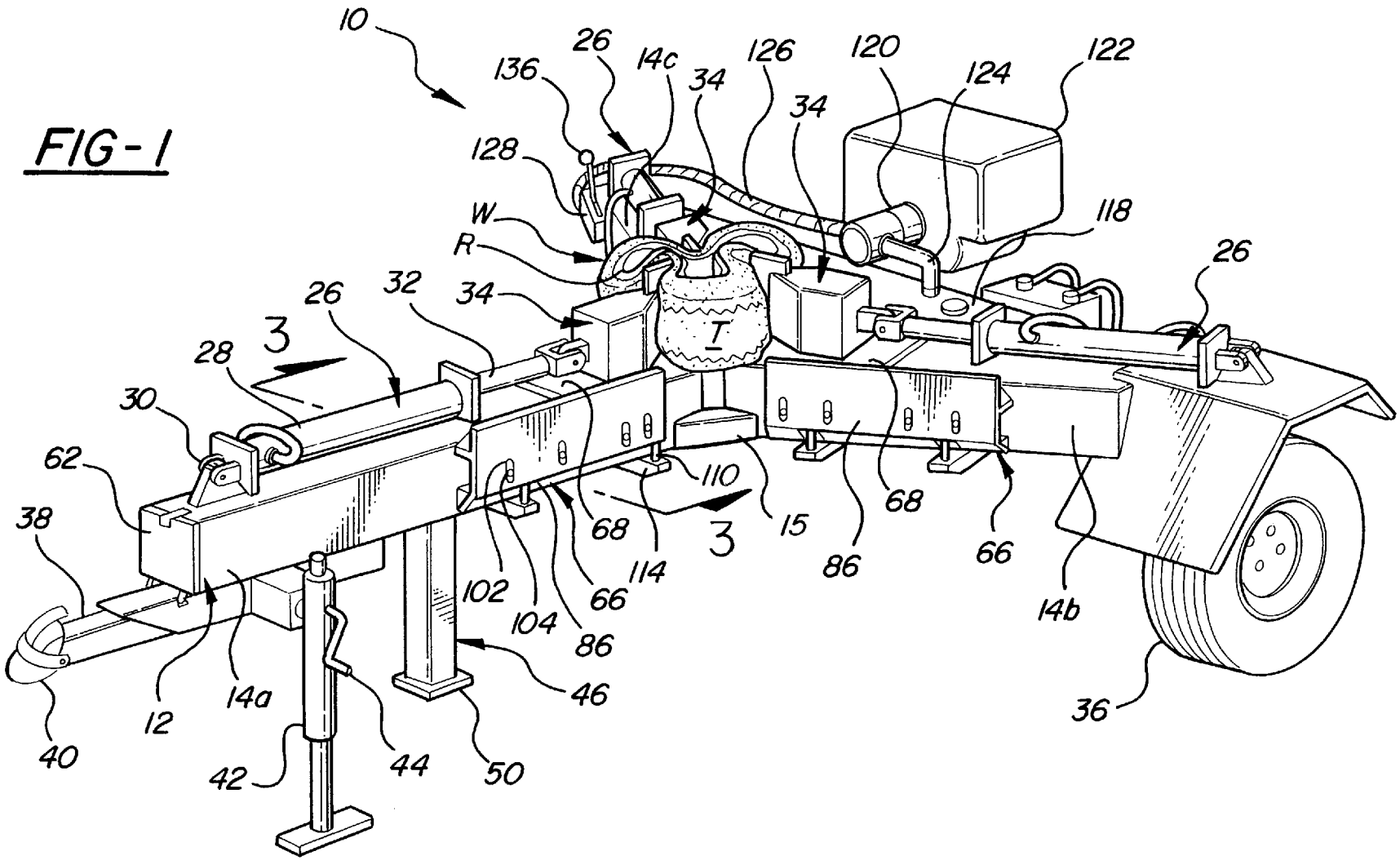
FIG. 1 is a perspective view of a wheel crushing apparatus constructed according to a presently preferred embodiment of the invention.

Apparatus constructed in accordance with a presently preferred embodiment of the invention is indicated generally by the reference number 10 in the drawings and comprises a rigid frame 12 having at least three radially disposed beams 14 that converge and are joined to one another at a central portion 16 of the frame 12. The beams 14 are each constructed from rectangular metal tubing having generally horizontally disposed top and bottom walls 18, 20, and a pair of vertically disposed side walls 22, 24 as illustrated best in FIG. 3. The beams 14 are preferably constructed from ⅜" thick 6"×8" steel tubing, although tubing of larger or smaller size may be used. The term "rectangular" is meant to include square tubing.

Figure 2:
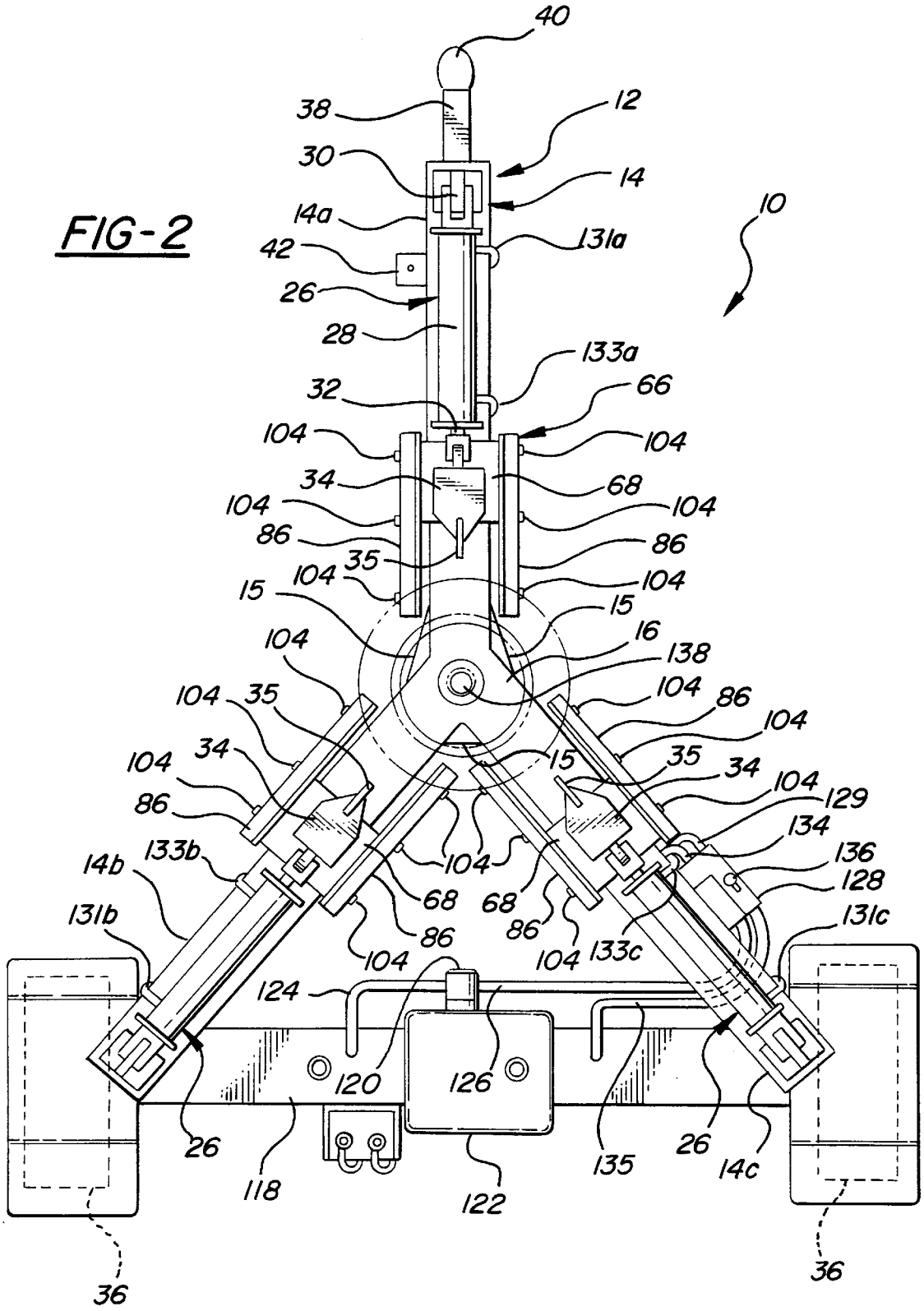
FIG. 2 is a top plan view of the apparatus of FIG. 1.

As shown best in the top view of FIG. 2, the beams 14 are spaced circumferentially from one another, but preferably not equally spaced. It is preferred that the angle between the two rearward most beams 14*b*, 14*c* be less than the angle formed between each rearward beam and the forward most beam 14*a*. The angle between the rear beams may be on the order of about 100°, whereas that between the rear beams and front beams may be on the order of about 130°. The purpose for reducing the angle between the rearward most beams 14*b*, 14*c* below 120° is to maximize their working length while minimizing the overall effective width of the apparatus 10 for compliance with maximum load restriction regulations. To the extent that the restrictions vary, the maximum width may vary. For example where maximum load width regulations permit trailers of 102 inches wide, the apparatus 10 may be constructed to have a width of about 101 ½ inches. The slight decrease in angle by about 10° or so, however, does not have any appreciable negative impact on the performance of the apparatus 10 when crushing a scrap wheel as far as balancing the radial forces applied to the wheel. Where the beams 14 come together, inside corner braces 15 are provided to strengthen the frame 12.

Figure 7:
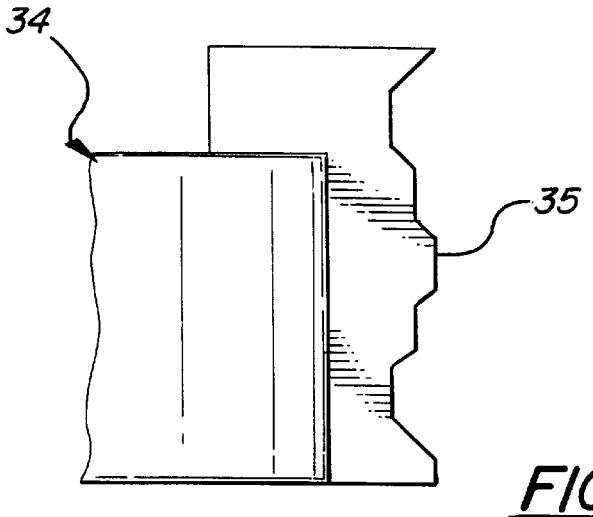
FIG. 7 is an enlarged fragmentary sectional view of the crushing head.

Mounted on each beam 14 is a linear actuator in the preferred form of a hydraulic cylinder 26 of conventional design having a cylindrical body 28 anchored to the beams 14 by pivot mounts 30 at their radially outer ends and guiding a slideable extension arm or shaft 32 that projects from the inner ends along each beam 14 radially toward the center 16 of the frame 12. A generally wedge-shaped crushing head 34 is fixed to the free end of each shaft 32 and is moveable therewith radially toward and away from the center 16 of the frame 12. As illustrated in FIG. 7, the crushing heads 34 carry a vertical crushing plate 35 having a generally W-shaped and preferably notched profile to nest with the wheel being crushed to minimize vertical slippage of the wheel during crushing.

The frame 12 mounts a pair of rear wheels 36 and is provided with a tow bar 38 that is fixed to the bottom side 20 of the forward most beam 14a and extends forwardly therefrom and terminates at a hitch coupling 40 for enabling the apparatus 10 to be towed by a vehicle (not shown). A conventional manual crank trailer jack 42 is mounted by a swivel bracket off the tow bar 38 and operates to selectively raise or lower the front of the frame 12 by operation of a conventional hand crank 44 to assist in coupling and uncoupling the apparatus 10 from a towing vehicle. When not in use, the jack 42 is rotated to a generally horizontal stowed position.

Figure 5:
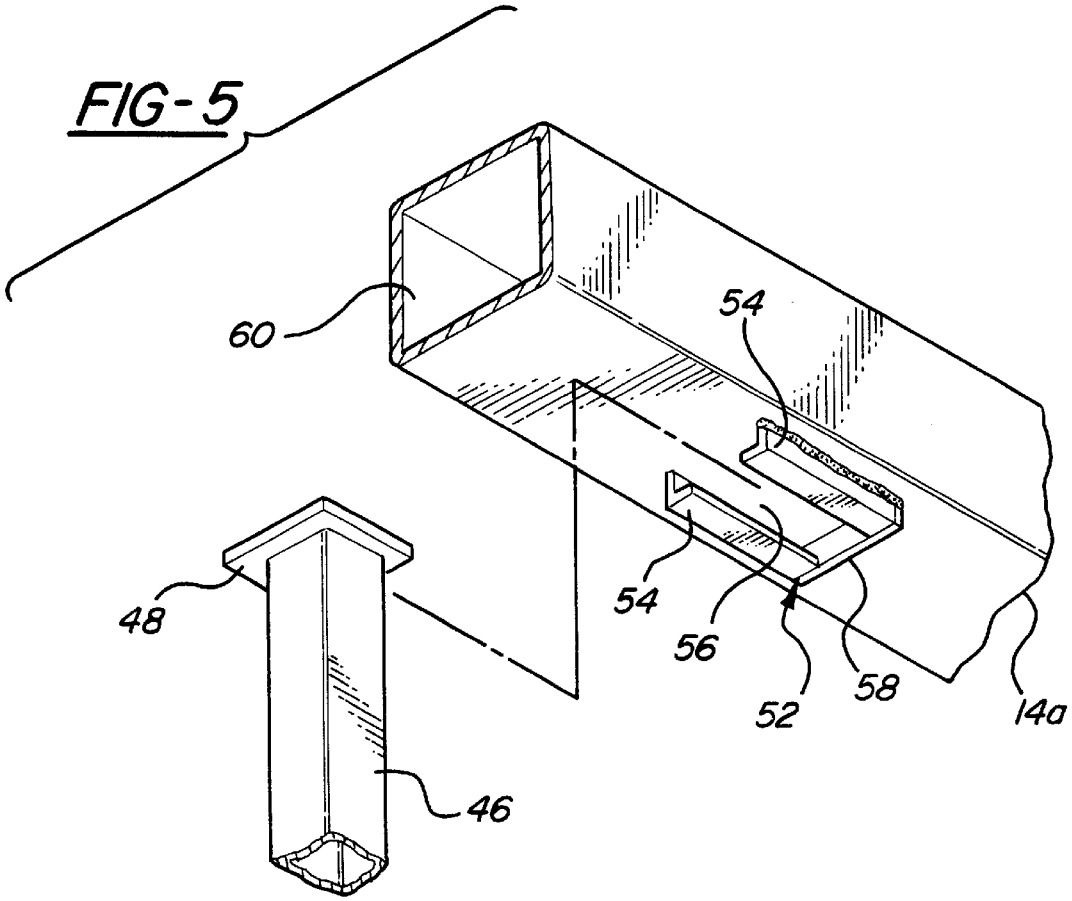
FIG. 5 is an enlarged fragmentary perspective view illustrating another feature of the invention.

A detachable front jack stand or support leg 46 is provided to support the front beam 14a of the frame 12 when the apparatus 10 is unhitched from the vehicle during crushing operations. (See FIGS. 1 and 5). The leg 46 is constructed from a length of rectangular metal tubing capped at its upper and lower ends by end plates 48, 50, respectively. At least the upper end plate 48 extends laterally beyond the sides of the leg 46 to serve as a mounting flange. A cooperating mounting bracket 52 is provided on the underside of the front beam 14*a* for releasably supporting the leg 46 in position on the beam 14*a*. (FIG. 5). The bracket 52 preferably comprises a pair of L-shaped, spaced apart, parallel members 54 defining a socket 56 that is open at one end to receive the top end plate 48 of the leg 46 slidably into the socket to trap the top plate 48 between the bracket 52 and bottom wall 20 of the beam 14*a*, and is closed at its opposite end by a transverse end wall 58.

Figure 4:
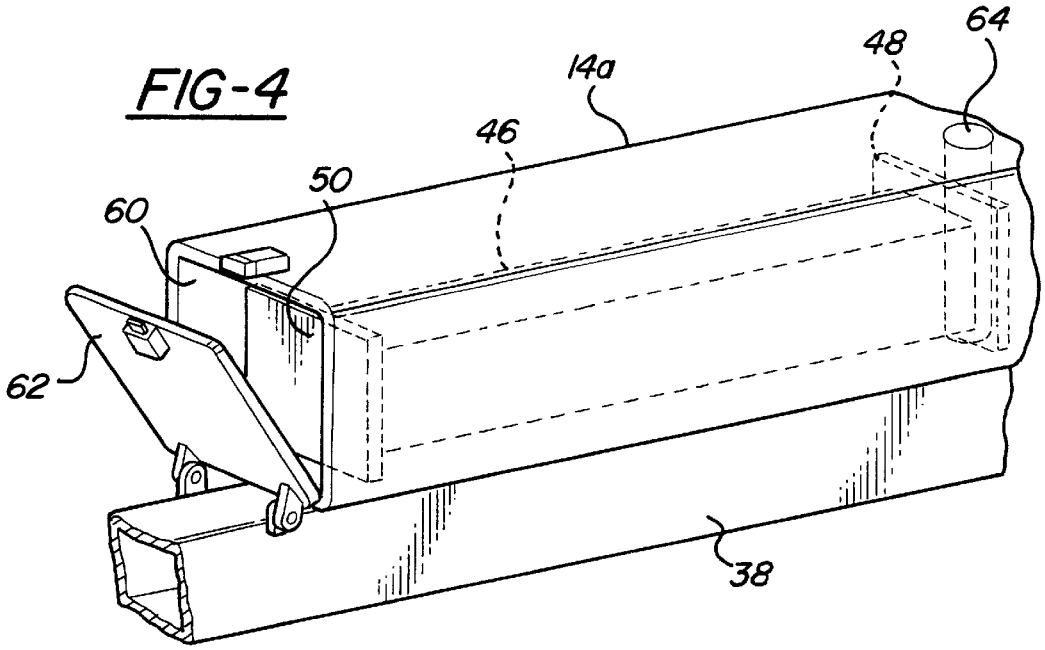
FIG. 4 is an enlarge fragmentary perspective view illustrating a feature of the invention.

When not in use, the leg 46 may be dismounted from the beam 14*a* by simply sliding it free of the bracket 52. As illustrated best in FIG. 4, the front beam 14*a* has a compartment 60 sized to stow the leg 46 when not in use. The compartment 60 is simply the interior space of the beam 14*a* and may be selectively accessed from the front end of the beam 14*a* through a latchable hinged door 62. The depth of the compartment 60 is limited by stop pin 64 as shown or an interior end wall (not shown).

Each crushing head 34 is tied or interlocked to its respective beam 14 by an adjustable slide connection or interlock system 66 which is identical in construction for each of the crushing heads 34. Each slide connection 66 includes a slideable component that is moveable with the crushing head 34 along the beam 14, and a stationary component which is fixed to the beam 14 and serves to guide the slideable component.

Figure 3:
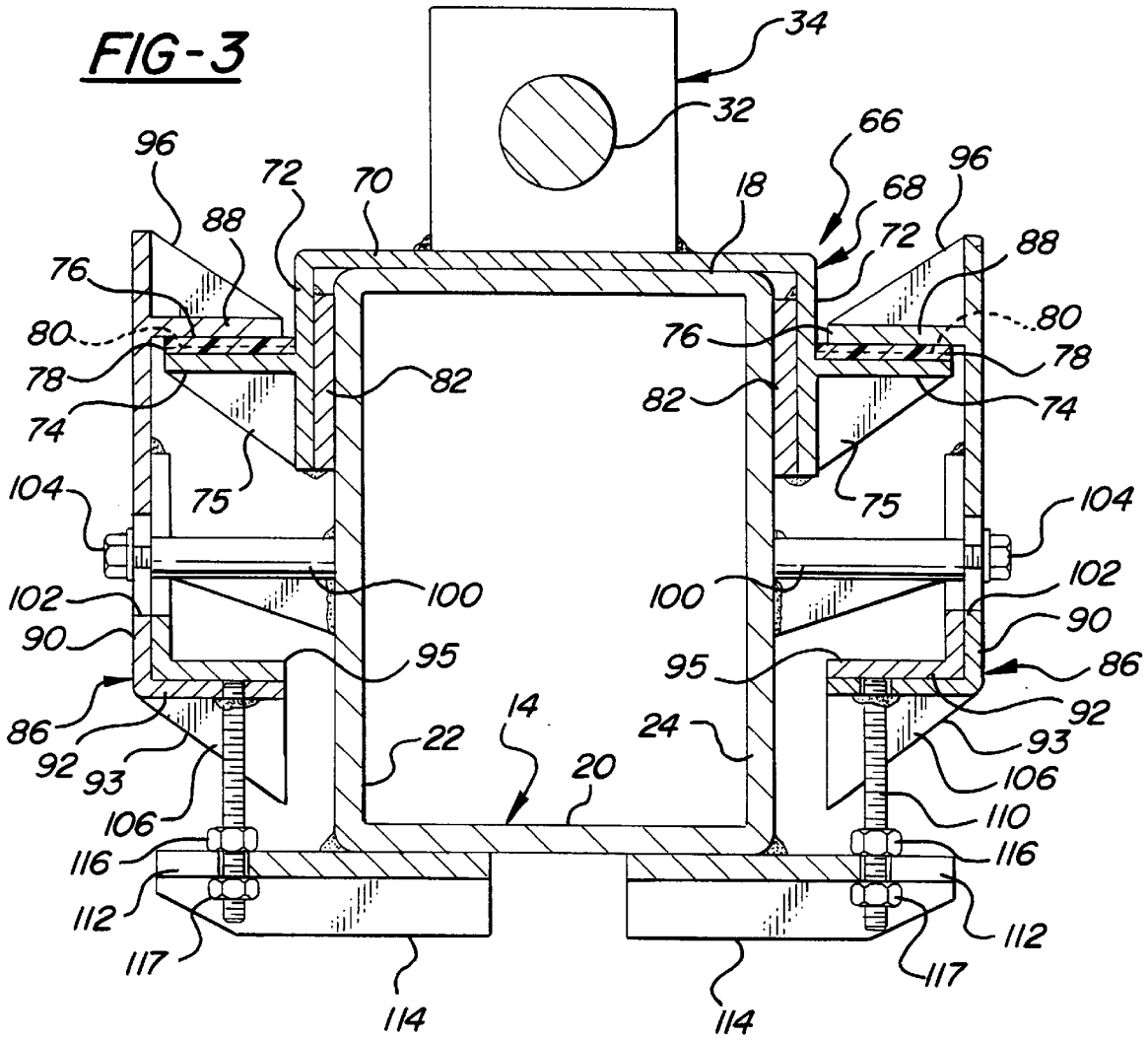
FIG. 3 is an enlarged cross-sectional view taken along lines 3—3 of FIG. 1.

As illustrated best in FIG. 3, the slideable component preferably comprises an elongate, generally U-shaped carriage or saddle 68 having a horizontal, generally planar upper wall 70 overlying the top wall 18 of the associated beam 14 and welded or suitably fixed to the associated crushing head 34 for movement therewith along the beam. Side walls 72 project downwardly from the upper wall 70 and straddle the opposing side walls 22, 24 of the associated beam 14. A flange 74 extends laterally outwardly from each side wall 72 presenting a generally horizontal top surface 76 on which a wear pad 78 is mounted. The flange 74 is reinforced from below at intervals along its length by gussets 75. The pads 78 are constructed preferably from a low friction synthetic material, such as nylon or the like, and mounted in such manner as to be replaceable when worn. The preferred means of mounting the pads 78 on the flanges 74 is to provide a transverse stop bar 80 to the longitudinal ends of the flange 74 which are positioned to flank the longitudinal ends of the pad 78 and thereby retain the pad 78 against sliding in the longitudinal direction relative to the flange 74 (FIG. 3). The pad 78 could also be secured by recessed screws.

As also illustrated in FIG. 3, the side walls 72 of the carriages 68 are spaced from the adjacent side walls 22, 24 of the beams 14 and are fitted on their inboard side with replaceable spacer or wear plates 82. The plates 82 are fabricated from unhardened steel and are fixed by welds or bolts to the carriage walls 72 and extend the length of the carriage 68. The plates have an initial thickness dimension that is about the same as or slightly less than the space in which they are accommodated in order to permit the carriages 68 to slide along the beams 14 while supporting the carriages against lateral movements. Should the plates 82 become worn to the point where they no longer provide adequate lateral support, they may be readily replaced by new plates by simply grinding off the welds or unfastening the bolts which mount them on the carriages 68.

The stationery component of each slide connection comprises carriage guides in the preferred form of a pair of brackets 86 mounted on either side of each beam 14 along the length of the travel path of the carriages 68. Each bracket 86 has a hold down flange 88 supported in overlying relation to the flanges 74 of the carriage 68. The brackets 86 have a generally C-shaped configuration with a generally vertical side wall 90, a generally horizontal top wall defining the flange 88 reinforced by gussets 96, and a bottom wall 92 projecting inwardly toward the beam 14 and reinforced from below by a solid reinforcement bar 93 extending the length of the bottom wall 92 and on the inside by an L-shaped brace 95.

The brackets 86 are mounted on the beam 14 in such manner as to be adjustable vertically relative to the beam 14 and slide carriage 68, while being supported against longitudinal movement along the beam 14 so that the hold down flange 88 may be positioned in confronting engagement with the wear pads 78 of the carriage flanges 74 and adjusted to account for wearing of the pads 78 or to apply more or less hold down pressure on the carriage flanges 74. As shown best in FIGS. 1 and 3, a plurality of internally threaded mounting lugs 100 extend from either side of the beam 14 (four shown on each side) at spaced apart locations along the length of the brackets 86. The brackets 86, in turn, have vertically oriented mounting slots or elongate openings 102 corresponding in number and position to the mounting lugs 100, though which fasteners 104 extend and are threaded into the lugs 100 to secure the brackets 86 against lateral and longitudinal movement relative to the beam while permitting selective vertical adjustment of the brackets 86.

The reinforcement bar 93 of each bracket 86 is formed with at least two alcoves 106 from which a threaded post 110 depends and passes through aligned slotted openings 112 provided in associated mounting brackets 114 fixed to and projecting laterally outwardly of the sides of the beam 14. Each post 110 carries a lock nuts 116, 117 on opposite sides of the opening 112. Tightening the lower nut 116 against the bracket 114 advances the post 110 and hence the bracket 86 on which it is mounted vertically downwardly. By adjusting the tightness of the lower nut 117, one is able to control the hold down pressure that each flange 90 exerts on its associated carriage flange 74. When the desired vertical position of each bracket 86 is attained, it may be secured in the desired vertical position by tightening the upper jam nut 116 against the bracket 114.

Hydraulic fluid is contained in an onboard reservoir or supply tank 118 which may be conveniently bolted to the frame 12 so as to be removable therefrom should the need arise. A suitable hydraulic supply pump 120 is operated by an onboard gasoline engine 122 to draw fluid from the tank 118 through a fluid intake line 124 and direct it through supply line 126 to a suitable control valve 128.

Figure 6:
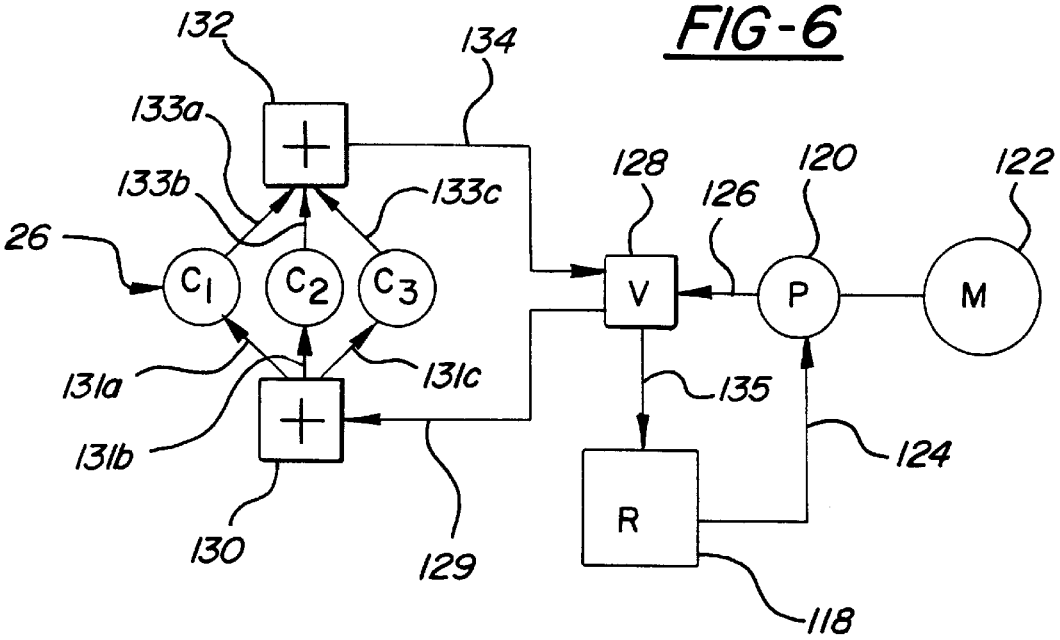

As best shown in FIG. 6, fluid from valve 128 is fed by line 129 to a first 4-way fitting or juncture 130 which divides the flow into three branches where it is delivered by feed lines 131*a*, 131*b*, 131*c* to each of the cylinders 26 (identified in FIG. 6 as $C_1$, $C_2$, and $C_3$) to advance the crushing heads 34 inwardly. An identical second 4-way fitting 132 is provided to merge the three return lines 133*a*, 133*b*, 133*c* of the cylinders 26 into a single line 134 back to the valve 128. Fluid returned from the cylinders 26 is recirculated back to the supply tank 118 via dump line 135 coming from the valve 128. The 4-way fittings and various lines to and from the cylinders 26 may be conveniently routed and mounted beneath the beam members 14. The direction of fluid flow is controlled by an actuator lever 136 of the valve 128 in known manner.

Figure 8:
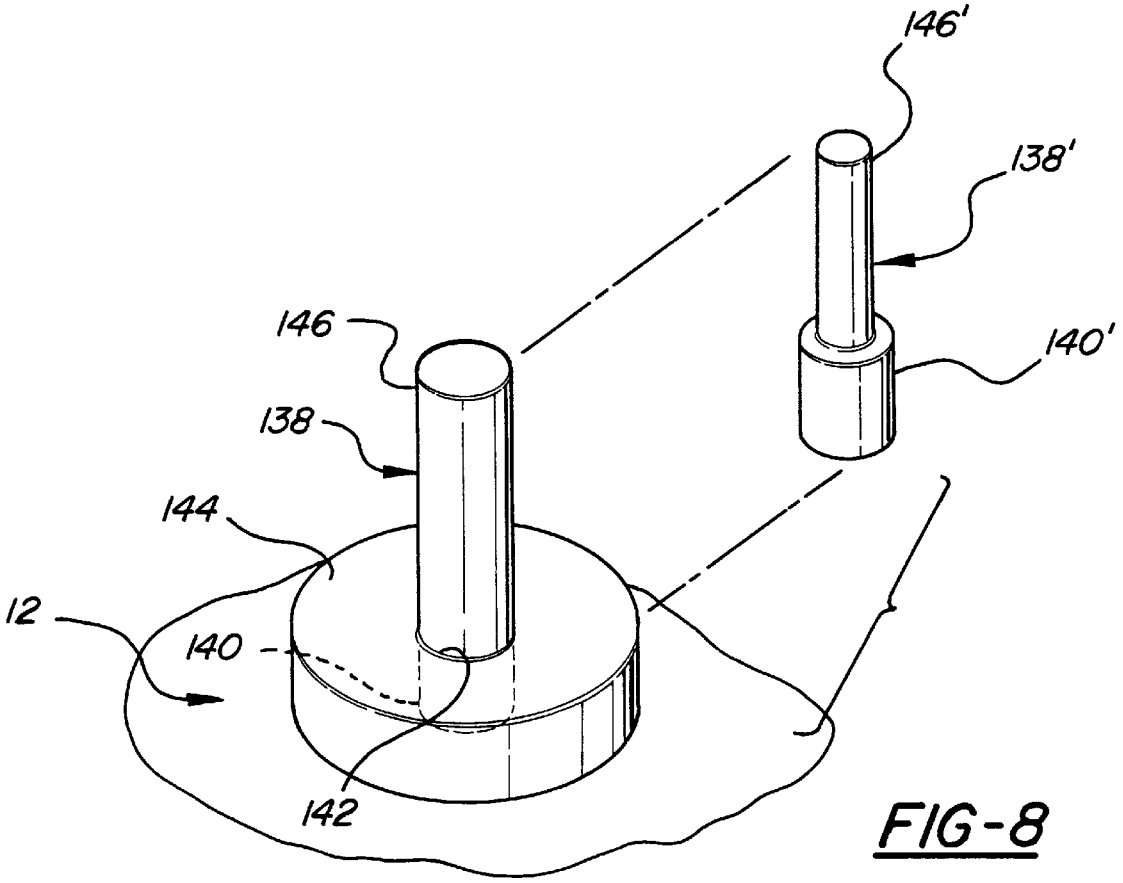
FIG. 8 is an enlarged fragmentary perspective view of the wheel support center post.

In operation, the crushing heads 34 are retracted and a scrap wheel W to be crushed is placed on its side at the central portion 16 of the frame 12 as illustrated in FIG. 2. The term "scrap wheel" is understood to include an assembled tire T and metal rim R arrangement, where the object is to crush and permanently deform the rim R into a three-leaf clover shape allowing it to be easily separated from the surrounding tire T which returns to its original shape after deformation. As shown in FIG. 3, the brackets 86 preferably extend sufficiently inwardly to support the wheel W above the beams 14. An upstanding center post 138 may be provided at the center of the frame 12 in order to locate and support the wheel W centrally on the frame 12 for crushing. As shown in FIG. 2, the post 138 is designed to extend through the central hub opening of the wheel W in order to center the wheel and hold it in position during crushing. The preferred construction of the centering post 138 is shown best in FIG. 8. The post 138 comprises a cylindrical bar having a lower end portion 140 removably accommodated in a bore 142 of a cylindrical pad or platform 144 fixed to the frame 12. An upper end portion 146 projects above the platform 144 and has a diameter selected to be equal to or less than the hub opening of the wheels W to be crushed. The post 138 may be interchanged with one or more alternative posts 138' whose upper end portion 146' is of a different diameter to accommodate wheels with larger or smaller hub openings, as the case may be.

After the wheel W is loaded, the operator moves the control lever 136 of the valve 128 to a wheel crushing position in order to direct the flow of fluid to the cylinders 26 and thereby displace the crushing heads 34 radially inwardly until they engage and deform the wheel W into the three three-leaf clover shape shown in FIG. 1. The operator then retracts the crushing heads 34 by reversing the direction lever 136, whereupon the tire T returns to its original circular shape away from the crushed metal rim R enabling the components to be removed and separated from one another and readying the apparatus 10 for crushing another wheel.

Advantageously, the hydraulic fluid system of the invention lacks an equalizing valve which normally is provided for purposes of equalizing the delivery of fluid and thus the relative actuation of the cylinders so that the crushing heads advance equally toward the center. According to the invention, such control over the relative displacement of the crushing heads can be achieved by adjusting the hold down pressure exerted by the brackets 86 on each of the slide carriages 68. As the pads 78 wear over time, the equalization of the cylinders may be maintained by adjusting the brackets 86 vertically downwardly as needed.

The disclosed embodiment is representative of a presently preferred form of the invention, but is intended to be illustrative rather than definitive thereof. The invention is defined in the claims.

I claim:

1. Apparatus for crushing vehicle wheels comprising:

a rigid frame having at least three radially disposed beams converging at a central region of said frame, said beams each having an elongate rectangular tube construction providing generally horizontally disposed top and bottom walls and generally vertically disposed side walls;

a linear actuator mounted on each of said at least three beams, each actuator having an extension arm projecting toward said central region and a crushing head mounted on a free end of said extension arm, said actuators being operative to displace said crushing heads radially inwardly toward said central region so as to impinge upon and radially deform a wheel when supported at said central region of said frame and to return said heads radially outwardly to release the crushed wheel and ready the apparatus to crush a subsequently loaded wheel; and an adjustable slide connection provided between said crushing heads and their respective beams, said connection including a generally U-shaped elongate carriage having an upper wall overlying each of said top walls of said beams and fixed to said crushing heads for movement therewith and a pair of laterally spaced side walls straddling said side walls of said beams, said carriages each having a pair of flanges extending laterally outwardly of said side walls of said carriages, said connection further including stationary carriage guides mounted on said beams along the travel path of said carriages and supported by said beams against longitudinal movement along said beams, said carriage guides having hold down flanges overlying said lateral flanges of said carriages to secure said carriages and said crushing heads against upward deflection when under load, said guides being vertically adjustable relative to said carriages and said beams to enable adjustment in the position of said hold down flanges relative to said lateral flanges of said carriages.

2. The apparatus of claim 1 wherein said carriage guides each comprise a pair of brackets mounted on said sides of each beam in vertically adjustable relation thereto and supporting said hold down flanges in position over said lateral carriage flanges.

3. The apparatus of claim 2 wherein said beams include mounting portions projecting laterally from said side walls of said beams, and said brackets including vertically adjustable fasteners joining said brackets adjustably to said mounting portions.

4. The apparatus of claim 3 wherein said vertically adjustable fasteners comprise threaded shanks fixed at one end to said brackets and having an opposite free end projecting through corresponding aligned openings formed in said mounting portions, and a pair of nuts threaded onto each shank and confronting opposite sides of said mounting portions.

5. The apparatus of claim 3 wherein said brackets include vertically extending adjustment slots and corresponding fasteners extending through said slots and secured to said beams.

6. The apparatus of claim 1 wherein said actuators comprise hydraulic cylinders.

7. The apparatus of claim 6 wherein said cylinders are in direct flow communication with a hydraulic pump and valve, and where said vertical positioning of said hold down flanges of said carriage guides are individually adjustable to apply a varying amount of clamping pressure to said carriage flanges so as to equalize any imbalance of actuation among said cylinders.

8. The apparatus of claim 1 wherein at least one of said tubular beams has an access opening into the interior thereof to define a storage compartment and an associated closure member operative to open and close said compartment.

9. The apparatus of claim 8 wherein said frame includes wheels and a hitch coupling to render said apparatus towable, and a removable jack stand sized for accommodation within said storage compartment.

10. The apparatus of claim 1 wherein said frame includes wheels and a hitch coupling rendering said frame towable.

11. The apparatus of claim 10 wherein one of said beams is forwardly extending and mounts said hitch coupling and the remaining two of said beams diverge rearwardly from said forward beam forming an angle with said forward beam that is relatively greater than an angle formed between said remaining two rearward beams.

12. The apparatus of claim 1 including a low friction wear pad mounted on an upper surface of said lateral flanges.

13. The apparatus of claim 12 wherein said low friction pad is fabricated of nylon.

14. The apparatus of claim 12 wherein said carriage guides are provided with grease fittings to accommodate the introduction of lubricant between said hold down flanges and said wear pads of said carriages.

* * * * *